United States Patent [19]

Gertsch

[11] Patent Number: 4,646,636

[45] Date of Patent: Mar. 3, 1987

[54] DEVICE FOR THE DRAWING IN OF MATERIAL WEBS IN ROTARY PRESSES

[75] Inventor: Peter Gertsch, Niederscherli, Switzerland

[73] Assignee: Maschinenfabrik Wifag, Switzerland

[21] Appl. No.: 808,900

[22] Filed: Dec. 13, 1985

[30] Foreign Application Priority Data

Dec. 18, 1984 [CH] Switzerland ..... 05977/84

[51] Int. Cl.[4] ..... B41F 13/02

[52] U.S. Cl. ..... 101/228; 101/219; 226/33; 226/92; 226/126

[58] Field of Search ..... 101/143, 181, 219, 228; 226/33, 62, 126

[56] References Cited

U.S. PATENT DOCUMENTS

| | | | |
|---|---|---|---|
| 2,862,705 | 12/1958 | Faeber | 101/228 |
| 3,761,001 | 12/1973 | Schunemann et al. | 226/92 |
| 3,995,553 | 12/1976 | Winterholler | 101/228 |
| 4,070,965 | 1/1978 | Aenishaewslin et al. | 101/228 |
| 4,111,122 | 9/1978 | Kutzner | 101/228 |
| 4,153,191 | 5/1979 | Bishop | 101/228 |
| 4,370,927 | 2/1983 | Fischer | 101/228 |
| 4,401,028 | 8/1983 | Kobler et al. | 101/228 X |
| 4,404,907 | 9/1983 | Kobler et al. | 101/228 |
| 4,480,801 | 11/1984 | Stone | 101/228 |
| 4,598,850 | 7/1986 | Winterholler et al. | 101/228 X |

*Primary Examiner*—E. H. Eickholt

*Attorney, Agent, or Firm*—McGlew and Tuttle

[57] ABSTRACT

For the drawing in of material webs in web-fed rotary presses a driven draw-in element is used which has a finite length extent and which is moved along different, preadjustable draw-in paths. Guides are disposed along the draw-in paths which provide interruptions which improve the accessibility of the printing units of the presses. For the passage through these guideless regions the draw-in element is stiffened.

8 Claims, 7 Drawing Figures

DEVICE FOR THE DRAWING IN OF MATERIAL WEBS IN ROTARY PRESSES

FIELD AND BACKGROUND OF THE INVENTION

The invention relates to printing presses and in particular to a new and useful device for the drawing in of material webs in rotary presses by a driven draw-in element of finite length operating along guides which lie outside the cylinder area and which are equipped with branchings by which the draw-in path is pre-adjustable.

Such devices for the drawing in of material webs in rotary presses are already known. Thus, for example, German patent No. 20 21 246 shows a draw-in device in the form of a motor carriage which introduces a paper web into the rotary press along a cog rail guide on a desired guide track adjustable by means of switches.

A further draw-in device is shown in German patent No. 22 41 127. There the draw-in element (which is movable back and forth in guides along the draw-in path adjusted by means of switches, the drive elements being fast to the machine frame) has a finite length extension and is flexible.

These devices have the disadvantage that the guides for the respective draw-in element must be mounted fixed without a gap along each desired draw-in path, resulting in particular in the area of the printing units in a great accumulation of guides, which at least complicate the free access to the printing units.

Another disadvantage consists in that, especially in the multiple printing of a material web, the web is guided around adjustable register and/or regulating rolls. As the position of these rolls within an adjustment region may be any, the guiding of the draw-in element must make it possible that as the material web is being drawn in, these rolls are enveloped by it in any event, regardless of the position of the rolls. What this means is that the guide must go around the roll when the roll is in its extreme position, i.e. when the draw-in path, for example, between two printing units has the greatest possible length. But if the roll is not in the extreme position, as is normally the case, there occurs during the draw-in process of the material web a so-called bag formation, which is undesirable and disturbing.

SUMMARY OF THE INVENTION

The invention provides a draw-in device for rotary presses which make possible good accessibility in particular to the printing units, and which can envelop with the material web also rolls whose position is adjustable, without a bag formation occurring.

According to the invention, the guides applied along the draw-in path have interruptions and the draw-in element is stiffenable at least over a partial region of its length for the running through of these guideless interruptions.

Accordingly it is an object of the invention to provide a device for facilitating the drawing in of a web to be printed as it is moved into and out of association between a pressure roller and a plurality of rubber cylinders arranged around the periphery of the pressure roller and which comprises a plurality of drawing paths defined adjacent the pressure roller which include a plurality of roller guides over which the web is passed. The guide piece is associated with at least some of the roller guides for guiding the web through the interruption path over said rollers and which includes a draw-in device engageable with the web and movable through the guide pieces and which comprises first and second pivotally interconnectable members which may be latched together in a stiffened position or unlatched by deflecting a switching lever carried by one of the members during its movement.

A further object of the invention is to provide a device for facilitating the drawing in of a web to be printed as it is advanced in a printing operation which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
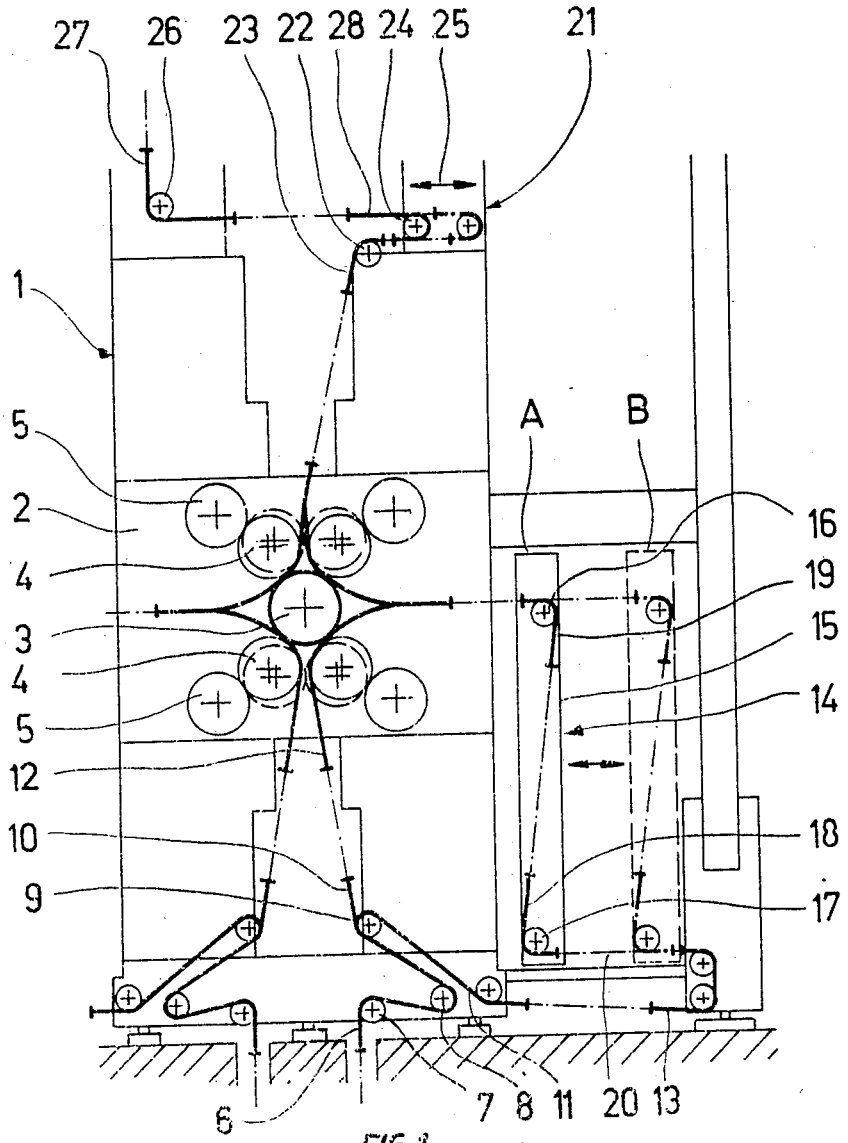
FIG. 1 shows a simplified schematic side elevational view of a 9-cylinder printing unit with the guide pieces for the draw-in element.

Referring to the drawings in particular the invention embodied therein comprises a device for facilitating drawing in of a web to be printed as it is moved into and out of association between a pressure roller 3 and one or more of a plurality of rubber cylinders 4 which are associated with the pressure roller.

Figure 2:
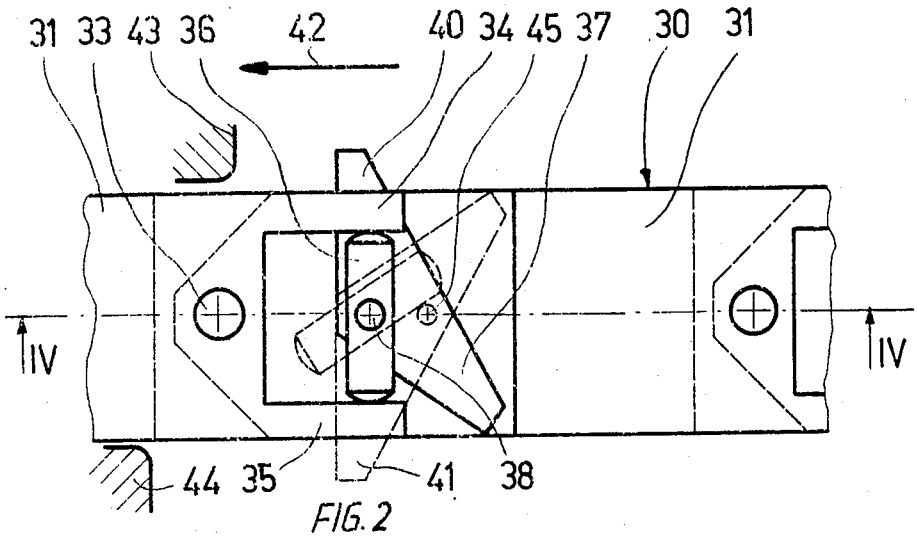
FIG. 2 shows an elevational view of the draw-in element of FIG. 1 in the locked and unlocked states.
Figure 3:
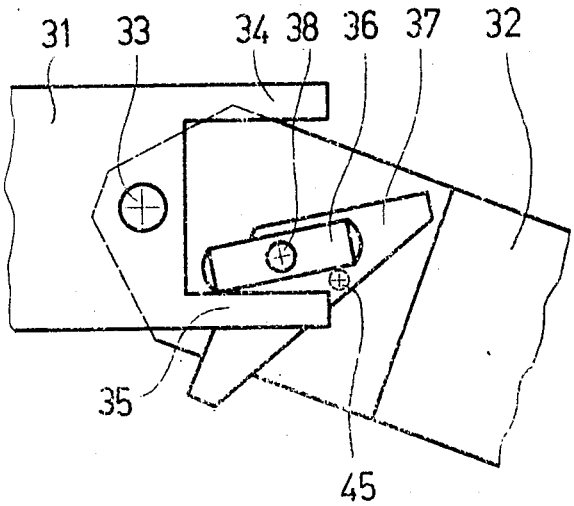
FIG. 3 is a view similar to FIG. 2 of the draw-in element in the disengaged state.

In accordance with the invention a plurality of drawing in paths are defined adjacent the pressure roller 4 and they include a plurality of roller guides for guide pieces 6,7,8, etc. over which the web is passed. The guide piece such as 10,11, etc. is associated with at least some of the roller guides for guiding the web through an interruption path over the rollers. In accordance with a feature of the invention, a draw-in device generally designated 30 as shown in FIGS. 2 and 3 is engageable with each web and movable through the guide pieces associated with the draw-in paths. The draw-in device comprises first and second pivotally interconnected members 30 and 31 having latch means such as a pivotal latch 36 which may be engaged therebetween for holding the pivotal members in a rigid extended position. In addition a deflectable switching lever 37 is carried by one of the members, for example the member 31 or 32 and it is positioned such that stop elements such as stops 43 and 44 will effect the deflecting of the lever members so as to shift the latching means so as to selectively release the members or to permit their stiffening in respect to each other.

FIG. 1 shows in simplified representation a reversible or switchable 9-cylinder printing unit 1 for the printing of paper webs. Rubber cylinders 4 are arranged transposable around a counter-pressure cylinder 3 mounted in a machine frame 2, with a respective plate cylinder 5 all arranged to permit several known possibilities for the printing of a paper web. To be able to fully utilize these possibilities, the webs to be imprinted must be able to be drawn in on a variety of paths through the printing units.

For this purpose, the beginning of a roll of paper is fastened in known manner at a draw-in element of finite length, as illustrated in FIGS. 2 to 5. The drivable draw-in element then reaches with the paper web appended at the rear end for example, the guide piece 6, which is mounted at a fixed location on the machine frame 2. The web moves into the guide piece 6, and is conducted around guide rolls 7 and 8.

A branching 9 of the guide piece 6 makes possible the onward conduction of the draw-in element either via guide piece 10 or via guide piece 11. Just before the draw-in element moves beyond the end of the respective guide piece 10 or 11, it is stiffened gradually (step by step) and then approaches in a straight line the beginning of a similarly arranged further guide piece 12 or 13. As soon as the draw-in element has been seized by the new guide piece 12 or 13, the stiffening is gradually released again.

After the guide piece 13 the draw-in element runs through a so-called shift carriage 14 consisting of a frame 15 and two guide rolls 16,17.

Applied at frame 15 of the shift carriage 14 are guide pieces 18, 19 which lead the draw-in element around the guide rolls 16, 17.

The shift carriage 14 can be shifted from its left position A, shown in solid lines in FIG. 1, via mechanisms and guides (not shown), to the right-hand position B, shown in broken lines in FIG. 1. This shifting of the shift carriage 14 with the web drawn in makes it possible to remove the web from the printing unit without any change in the web length, in order thereby to provide optimum access for example to the printing unit 1. Since there is between the guide piece 13 and guide piece 18 a free stretch 20 without guides for the draw-in element, the length of which can be traveled through by the draw-in element independently of the position of the shift carriage 14, the web is always drawn in optimally by the shift carriage 14 without occurrence of bag formation in the web due to overly long draw-in paths. As the draw-in element leaves the shift carriage 14, the above described process repeats.

In the region of the printing cylinders, the guide pieces are arranged in known manner in such a way that there can take place a leading in or away of the web horizontally to the left or to the right and vertically up or down, passing through one, two, three, or all four printing units. These possibilities of web conduction through the printing unit 1 are achieved in the drawing in of the web by means of draw-in elements by known reversible branchings of the guides.

In FIG. 1, the web, which is conducted away upwardly, passes through a regulating device 21, which can regulate the web length for example between two printing units. This regulating device 21 comprises a guide roll 22 mounted fixed but rotatably at the machine frame 2, and having a guide piece 23 likewise arranged fixed for the deflection of the draw-in element. The regulating device includes a regulating roll 24 which is rotatably mounted in a slide (not shown) which is displaceable in the directions of the double arrow 25, and a fixed guide roll 26 which likewise possesses a fixed guide piece 27. Mounted on the slide of the regulating roll 24 is a guide piece 28 which guides the draw-in element around the regulating roll 24. Here, too, the lengths of the free stretches which must be traversed by the draw-in element between the guide pieces 23 and 28, or respectively guide pieces 28 and 27, are different depending on the position of the regulating roll 24, but here too the draw-in element follows the optically applied guide pieces 23, 28 and 27 without a bag formation occurring during the drawing in of the web.

Figure 4:
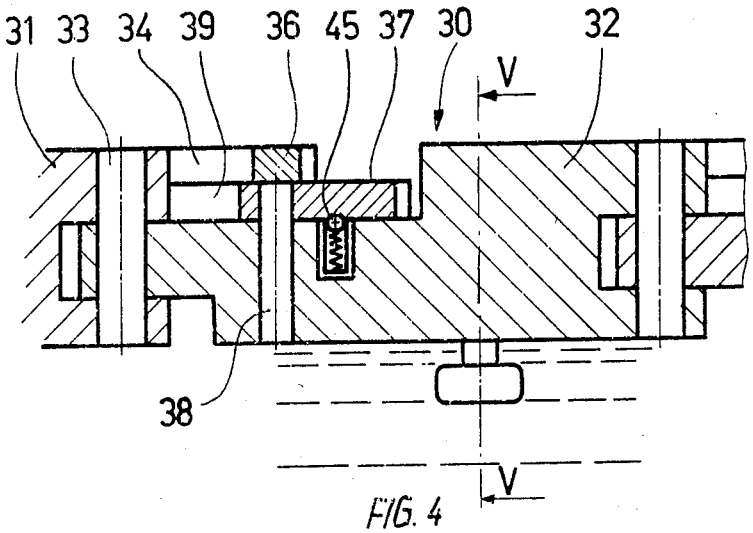
FIG. 4 is a longitudinal section IV—IV through line IV—IV of the draw-in element shown in FIG. 2.

As can be seen from FIGS. 2 to 4, the draw-in element 30 is composed of individual members 31 and 32, which are articulatedly joined together by a pivot axle 33. At its upper edge, the end of the member 31 has two projecting cams 34 and 35. Between these cams 34, 35, on the articulated members, a latch 36 is arranged which is firmly connected with a triangular switching lever 37, which together with the triangular switching lever 37 is rotatably mounted on an axle 38 which is disposed parallel to the axis of rotation 33. When the latch 36 is at right angles to the longitudinal axis of the draw-in element 30, the members 31 and 32 are mutually stiffened.

The triangular switching lever 37 can turn in a space 39 between cams 34, 35 and the body of member 32 (FIG. 4). Depending on the position of the triangular switching lever 37, one corner 40 or 41 will then project beyond the lateral face of the draw-in element 30. These projecting corners 40 or 41 serve to lock or unlock the articulation between the members of the draw-in element 30 by the latch 36. When the draw-in element 30 moves in the direction of arrow 42 (FIG. 2), a fixed stop 43 pivots the triangular switching lever 37 about the axle 28 into the dotted position, i.e. the stiffened draw-in element is unlocked, this occurring during run-in onto a guide piece. The locking or stiffening occurs through a stop 44 disposed fixed on the other side of the draw-in element 30. This process is executed just before the exit from the guide piece. The triangular switching lever 37, therefore, can assume two positions, in which it is held by the spring-supported balls 45, the balls 45 engaging in corresponding recesses at the triangular switching lever 37.

FIG. 3 illustrates how the members 31 and 32 can be mutually deflected in the unlocked state.

Figure 5:
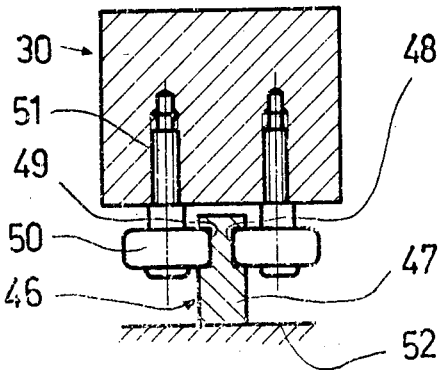
FIG. 5 is a transverse section V—V through line V—V of FIG. 4 of the draw-in element.

FIG. 5 shows a transverse section through a guide piece 46. This guide piece 46 comprises for example, a flat section 47, with tracks 48, 49 on both sides. Running in these guide tracks are rollers 50 which are rotatably mounted on axles 51 which are screwed into the members of the draw-in element 30. The guide piece 46 is firmly connected with a seating 52, which may be for example the machine frame 2.

Figure 6:
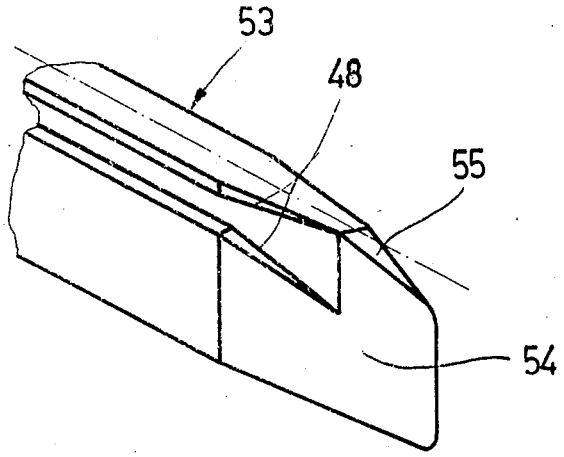
FIG. 6 is a perspective view of a guide piece beginning.

To facilitate the running in of the draw-in element 30 onto the guide piece 53, the beginning of the guide piece 53 is designed as follows (FIG. 6): the lateral faces 54 comes to a point, the upper face 55 is beveled at its end, the edges of the guide track 48 are widened in funnel form. Thereby the draw-in element 30 running onto the guide piece 53 centers itself. For the possible support of these guiding aids, additional guide plates (not shown) may be arranged.

Figure 7:
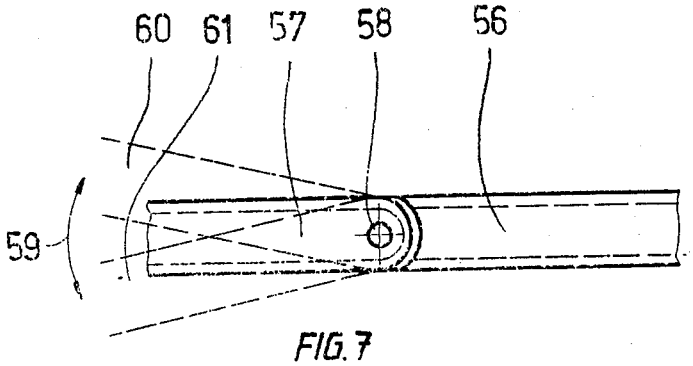
FIG. 7 is an adjustable steering device of the guide piece end.

FIG. 7 shows how for example the branchings of the guide pieces can be designed, or how the exit direction of the draw-in element 30, leaving a guide piece, can be adjusted. The fixed guide piece 56 is pivotably connected with the swivel piece 57 by a joint 58. The swiveling, indicated by the double arrow 59 and the swivel positions 60, 61 shown in broken lines, can occur through known positioning members.

The drive of the draw-in element 30 can occur in known manner either by fixed drive devices or by drive motors arranged on the draw-in element 30.

In addition, to reduce the draw-in forces acting on the web, the guide rolls may be driven during the draw-in process in known manner. The invention is not limited to the shown embodiment, since a number of possibilities are available to the specialist for applying the general idea of the new solution in a modified form.

While a specific embodiment of the inventon has been shown and described in detail to illustrate the application of the principles of the invention, it will be understood that the invention may be embodied otherwise without departing from such principles.

What is claimed is:

1. A device for facilitating the drawing in of a web to be printed as it is moved into and out of association between a pressure roller and a plurality of rubber cylinders arranged around the periphery of a pressure roller, comprising a plurality of drawing in paths defined adjacent the pressure roller including a plurality of roller guides over which the web is passed, guide pieces associated with at least some of said roller guides for guiding the web through an interruption path over said rollers, and a draw-in device engageable with the web and movable through said guide pieces which comprises first and second pivotally interconnected members, means for latching said members so that they are stiffened for passing through said guide member, and a deflectable switching lever carried by one of said members and being deflectable as it moves into association with said guide members, the deflection of said switching lever being effective to shift said latching means so as to selectively latch and release said members.

2. A device according to claim 1, wherein said interruption path includes portions which have no guide pieces which form guideless free stretches having a greatest extent which is smaller than the length of said interconnected members when they are held by said latching means.

3. A device according to claim 2, wherein the beginning of at least one of said guide pieces comprises a funnel shaped member.

4. A device according to claim 1, wherein at least one of said guide pieces has an adjustable steering device for the selective adjustment of the exit direction of interconnected members.

5. A device according to claim 1, wherein said interconnected members have a pivotal axis therebetween, said latch comprising a member pivotally carried on one of said members and engageable with the other to hold it in a stiffened condition.

6. A device according to claim 5, wherein said latching means is moved to automatically stiffen the interconnected members so that they are rigid when they run into said guide means.

7. A device according to claim 6, wherein one of said interconnected members includes a recess formed between respective sides of an end thereof, a rotatable latch rotatably mounted on the other of said members from said recess and engageable in the recess, said latch being pivotal to extend transversely between the sides of said one member in the recess to hold the member rigid in respect to the other of said members.

8. A device according to claim 7, including a switching lever carried on the pivot of said latch member and having ends which are deflectable which may pivot to switch said latching member between the latched and unlatched position.

* * * * *